US008331842B2

(12) United States Patent
Bobo et al.

(10) Patent No.: US 8,331,842 B2
(45) Date of Patent: Dec. 11, 2012

(54) TONER HEATING APPARATUS WITH BELT AND NIP

(75) Inventors: Robert D. Bobo, Ontario, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 458 days.

(21) Appl. No.: 12/749,804

(22) Filed: Mar. 30, 2010

(65) Prior Publication Data

US 2011/0243622 A1 Oct. 6, 2011

(51) Int. Cl.
*G03G 15/20* (2006.01)

(52) U.S. Cl. ..... 399/341; 399/122; 219/216

(58) Field of Classification Search ..... 399/341, 399/122; 219/216
See application file for complete search history.

(56) References Cited

U.S. PATENT DOCUMENTS

| | | | | |
|---|---|---|---|---|
| 3,965,331 | A * | 6/1976 | Moser et al. | 219/216 |
| 4,928,148 | A * | 5/1990 | Higashi | 399/321 |
| 5,296,904 | A | 3/1994 | Jackson | |
| 5,325,165 | A * | 6/1994 | Ohgita et al. | 399/321 |
| 5,408,301 | A * | 4/1995 | Tokishige et al. | 399/69 |
| 5,716,750 | A | 2/1998 | Tyagi et al. | |
| 5,887,234 | A | 3/1999 | Aslam et al. | |
| 5,890,032 | A | 3/1999 | Aslam et al. | |

FOREIGN PATENT DOCUMENTS

JP 2002-221834 8/2000

* cited by examiner

*Primary Examiner* — David Gray
*Assistant Examiner* — G. M. Hyder
(74) *Attorney, Agent, or Firm* — Christopher J. White

(57) ABSTRACT

Apparatus for selectively providing a surface finish to a receiver having an image side, comprising three rotatable members forming two nips. A finishing belt is entrained around, and movable with, one of the rotatable members, and passes through one of the nips. The receiver engages one of the nips according to what surface finish is desired. One of the rotatable members is selectively rotated to draw the receiver through the engaged nip, and a heater heats the rotatable member of the engaged nip facing the image side to impart the desired surface finish.

12 Claims, 11 Drawing Sheets

TONER HEATING APPARATUS WITH BELT AND NIP

CROSS-REFERENCE TO RELATED APPLICATIONS

Reference is made to commonly assigned, co-pending U.S. patent application Ser. No. 12/491,320, filed Jun. 25, 2009, entitled "FUSING APPARATUS FOR HIGH SPEED ELECTROPHOTOGRAPHY SYSTEM," by Muhammed Aslam et al.; co-pending U.S. patent application Ser. No. 12/507,823, filed Jul. 23, 2009, entitled "OPTIMIZED FUSING FOR HIGH SPEED ELECTROPHOTOGRAPHY SYSTEM," by Richard H. Berg et al.; and U.S. patent application Ser. No. 12/749,819 filed Mar. 30, 2010, entitled "FORMING SURFACE FINISH BY ELECTROPHOTOGRAPHIC TONER FUSING," by Robert D. Bobo et al; the disclosures of which are incorporated by reference herein.

FIELD OF THE INVENTION

This invention pertains to the field of electrophotographic printing and more particularly to fusing toner to a receiver to produce a specified surface finish.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, toner particles are given a charge substantially opposite to the charge of the latent image, and brought into the vicinity of the photoreceptor so as to be attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan or process direction. This is typically the vertical (Y) direction of a portrait-oriented receiver. The direction perpendicular to the slow-scan direction is referred to as the fast-scan or cross-process direction, and is typically the horizontal (X) direction of a portrait-oriented receiver. "Scan" does not imply that any components are moving or scanning across the receiver; the terminology is conventional in the art.

Users require a variety of different surface finishes on prints. For example, a matte finish is typically preferred for black-and-white images, such as text documents, and a glossy finish is preferred for full-color images, such as photographs.

U.S. Pat. No. 5,887,234 to Aslam et al. describes a printer having a first fusing device for producing a low-gloss finish and a second printing device for producing a high-gloss finish. These two fusing devices are separate and do not share components.

U.S. Pat. No. 5,716,750 to Tyagi et al. describes a fixing apparatus for post-treating fused toner to relax residual stress in the toner and adjust the gloss of the finish. Post-treatment methods include reheating and applying a chemical plasticizer to the fused toner. This approach requires additional components, and in some embodiments chemical components, compared to fusing alone.

The approaches of the prior art require additional components and space to selectively provide surface finishes. There is a need, therefore, for an improved apparatus for fusing or glossing toner on a receiver in a space-limited printer.

SUMMARY OF THE INVENTION

According to the present invention, there is provided apparatus for selectively providing a surface finish to a receiver having an image side, comprising:

a. a first, a second, and a central rotatable member, the first and the central rotatable members arranged to form a first nip and the second and the central rotatable members arranged to form a second nip, wherein one of the rotatable members forming each nip is an impression member adapted to provide a respective desired surface finish to the image side of the receiver, and the other rotatable member forming each nip is a pressure member adapted to maintain the receiver in contact with the impression member while the receiver travels through the respective nip;

b. a finishing belt entrained around one of the rotatable members and movable with that rotatable member, so that the finishing belt passes through one of the nips;

c. a diverter disposed in a receiver feed path to selectively engage the moving receiver in a first or a second position, so that as the receiver moves along the feed path through the diverter in the first position, it engages the first nip, and as the receiver moves along the feed path through the diverter in the second position, it engages the second nip; and d. a structure for providing the selected surface finish, comprising:

i. a drive for selectively rotating the central rotatable member to draw the receiver through the engaged nip;

ii. a first heater effective when the diverter is in the first position to heat the impression member of the first nip to impart the first surface finish; and iii. a second heater effective when the diverter is in the second position for heating the impression member of the second nip to impart the second surface finish.

An advantage of this invention is that it reduces the space required to provide selectable surface finishes, and specifically to provide either a fused (matte) finish or a glossed (glossy) finish. Compared to prior art systems with four rollers (two to fuse and two to gloss), the present invention requires only three rollers to perform the same function. The invention provides improved release and heat transfer for glossing using a finishing belt. It can increase durability and reduce artifacts caused by receivers' damaging the components of the toner-heating apparatus. In various embodiments, the finishing belt advantageously provides a replaceable surface for the impression member of the glossing nip, reducing replacement costs in the event of damage to that member. Various embodiments provide adjustable gloss based on temperature, speed, and pressure. Various embodiments provide stable, repeatable gloss over a large operating range of temperature, speed, and pressure.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
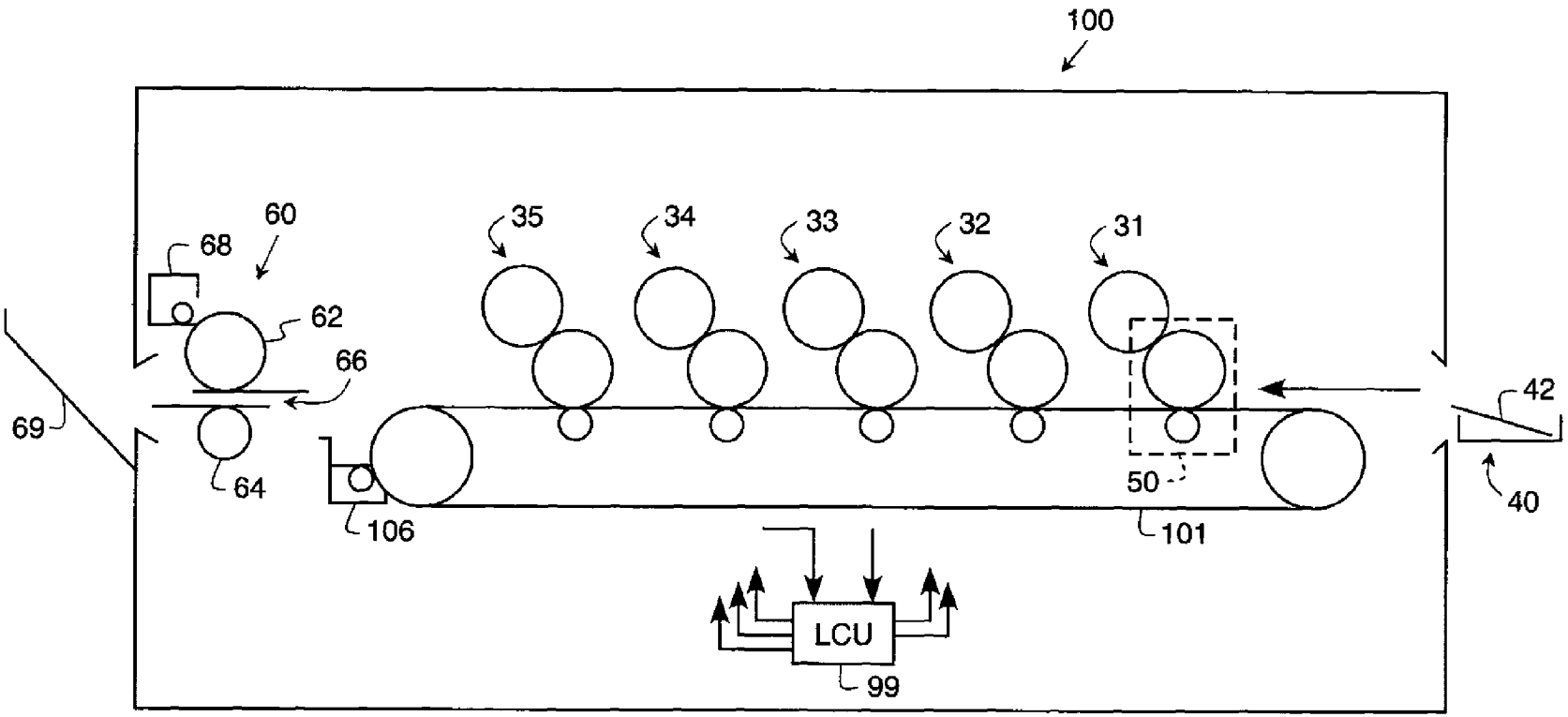
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, the terms "parallel" and "perpendicular" have a tolerance of ±10°.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles and that can form an image, pattern, or coating when deposited on an imaging member including a photoreceptor, photoconductor, or electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture of toner and magnetic carrier particles, which can be electrically-conductive or -non-conductive. Toner particles can be magnetic or non-magnetic. The carrier particles can be larger than the toner particles, e.g. 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography, printing using electrostatic fields, which is a subset of electrography, printing using electric fields.

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce original pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made sequentially in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for the transfer to the receiver of individual print images. Of course, in other electrophotographic printers, each print image is directly transferred to a receiver.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 101 transports the print-image-carrying receivers to fuser 60, which fixes the toner particles to the respective receivers by the application of heat and pressure. The receivers are serially de-tacked from transport web 101 to permit them to feed cleanly into fuser 60. Transport web 101 is then reconditioned for reuse at cleaning station 106 by cleaning and neutralizing the charges on the opposed surfaces of the transport web 101.

Fuser 60 includes a heated fusing roller 62 and an opposing pressure roller 64 that form a fusing nip 66 therebetween. Fuser 60 also includes a release fluid application substation 68 that applies release fluid, e.g. silicone oil, to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers carrying the fused image are transported in a series from the fuser 60 along a path either to a remote output tray 69, or back to printing modules 31 et seq. to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

Printer 100 includes main printer apparatus logic and control unit (LCU) 99, which receives input signals from the various sensors associated with printer 100 and sends control signals to the components of printer 100. The LCU can include a microprocessor incorporating suitable look-up tables and control software executable by the LCU 99. It can also include a field-programmable gate array (FPGA), programmable logic device (PLD), microcontroller, or other digital control system. The LCU can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for imaging substrates. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R) respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, by Peter S. Alexandrovich et al., and in U.S. Publication No. 2006/0133870, published on Jun. 22, 2006, by Yee S. Ng et al., the disclosures of which are incorporated herein by reference.

Figure 2:
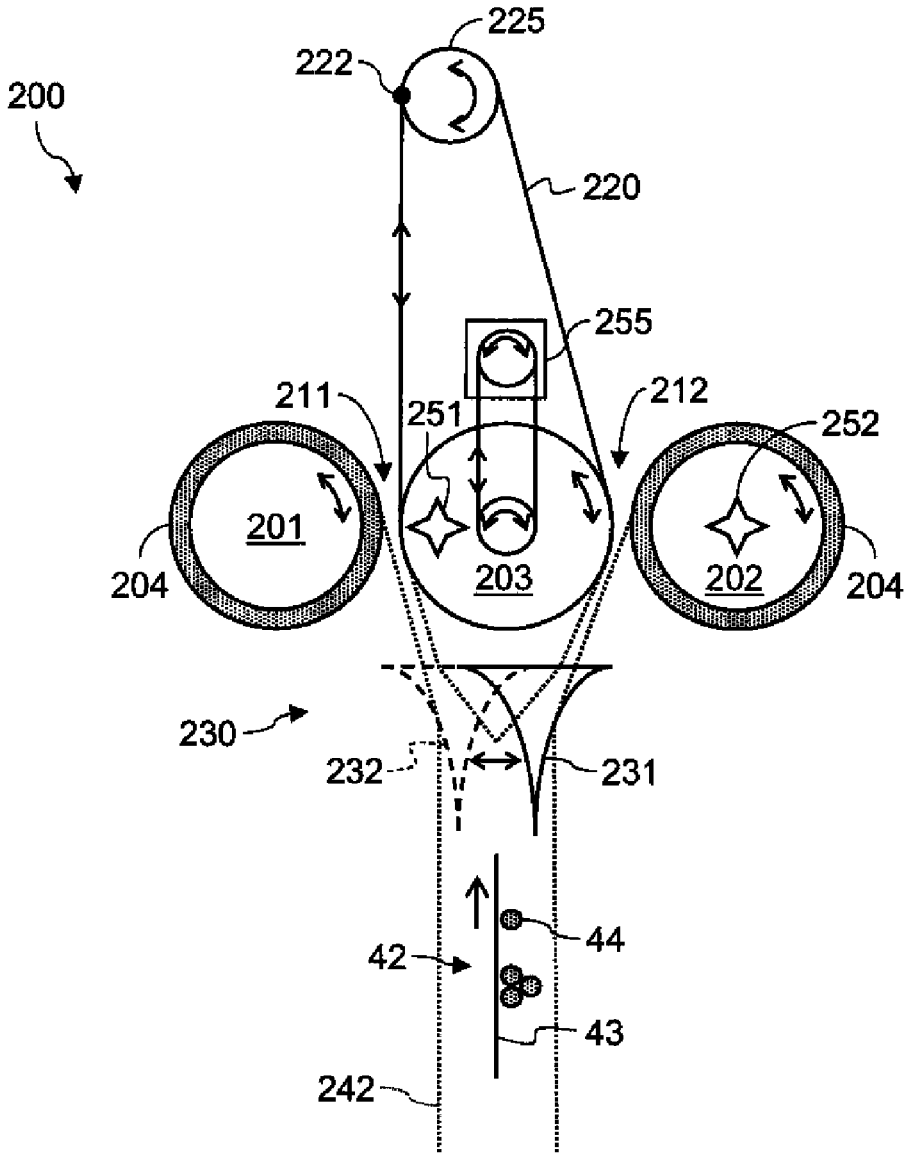
FIGS. 2-4 are elevations of apparatus according to various embodiments of the present invention.

FIG. 2 is an elevation of toner-heating apparatus 200 according to an embodiment of the present invention. Apparatus 200 heats toner 44 to selectively provide a surface finish to a receiver 42 having an image side 43.

First rotatable member 201, second rotatable member 202, and central rotatable member 203 are provided. First rotatable member 201 and central rotatable member 203 are arranged to form first nip 211, and second rotatable member 202 and central rotatable member 203 are arranged to form second nip 212. First rotatable member 201 and second rotatable member 202 are coated, wrapped, or covered with elastomer 204 to improve the release geometry of first nip 211 and second nip 212, as will be discussed below with reference to FIG. 8. The receiver engages one of the nips according to what surface finish is desired. The central rotatable member 203 is selectively rotated to draw the receiver through the engaged nip, and a heater heats the rotatable member of the engaged nip facing the image side 43 to impart the desired surface finish.

One of the rotatable members forming each nip is an impression member adapted to provide a desired surface finish to image side 43 of receiver 42, and the other rotatable member forming each nip is a pressure member adapted to maintain the receiver in contact with the impression member while the receiver travels through the respective nip. "In contact" does not require complete mechanical contact at all times; voids can be present between the two due to e.g. imperfections in the rotatable members or wrinkles, holes, or roughness in receiver 42. "Impression" does not require that the roller have any kind of pattern or texture, or print or press any image, pattern, or texture onto receiver 42. In this embodiment, first nip 211 has as its impression member central rotatable member 203, and as its pressure member first rotatable member 201. Second nip 211 has as its impression member second rotatable member 202, and as its pressure member central rotatable member 203.

Finishing belt 220 is entrained around one of the rotatable members, here central rotatable member 203, and movable with that member, so that the finishing belt passes through one or both of the nips. Finishing belt 220 is further entrained around tensioning roller 225 to maintain tension.

Diverter 230 is disposed in receiver feed path 242 to selectively engage the moving receiver 42 in a first position 231 or a second position 232, so that as receiver 42 moves along feed path 242 through diverter 230 in the first position 231, it engages first nip 211, and as receiver 42 moves along feed path 242 through diverter 230 in second position 232, it engages second nip 212. Diverter 230 is a sliding member that contacts receiver 42 on one of its two concave faces to direct receiver 42 to one of the nips (211, 212). In another embodiment, diverter 230 is a hinged plate controlled by a solenoid. The plate can have a lip to grip receiver 42 and direct it to the nip at which the plate is pointing.

Apparatus 200 includes a structure for providing the selected surface finish. The structure includes drive 255, first heater 251, and second heater 252. Drive 255 selectively rotates central rotatable member 203 to draw receiver 42 through the engaged nip (211 or 212), i.e. the selected nip through which receiver 42 is drawn. For first nip 211, central rotatable member 203 rotates clockwise; for second nip 211, it rotates counterclockwise.

First heater 251 (represented graphically as a four-pointed star) is effective when diverter 230 is in the first position to heat the impression member (central rotatable member 203) of first nip 211 to impart the first surface finish. First heater 251 can be active while receiver 42 passes through first nip 211, before receiver 42 reaches first nip 211, or both. The heating profile for first heater 251 can be selected by those skilled in the art to provide the desired surface finish.

Second heater 252 is effective when diverter 230 is in second position 232 for heating the impression member (second rotatable member 202) of the second nip 212 to impart the second surface finish. As with the first heater 251, second heater 252 can be active at various times, as can be determined by one skilled in the art. First heater 251 and second heater 252 can be positioned inside the rotating members, as shown, or outside the rotating members to directly heat the surface that contacts the receiver.

Drive 255 can be a servomotor, stepper motor, linear actuator driving a crankshaft, or other types of drive known in the art. First heater 251 and second heater 252 can be resistive, inductive, radiant, thermoelectric, combustion, convective, conductive, or other types of heaters known in the art.

FIG. 2 shows first rotatable member 201, second rotatable member 202, and central rotatable member 203 as rollers (drums). Any of the three can also be belts entrained around supplemental rollers, as will be apparent to those skilled in the art. In various embodiments, receiver 42 is a planar medium such as a piece of paper or a sheet of a transparency.

As shown in FIG. 2, first nip 211 is a glossing nip, and second nip 212 is a fusing nip. Finishing belt 220 passes through first nip 211 and second nip 212. In this embodiment, when toner 44 releases from second rotatable member 202, it is preferably at a temperature above its glass-transition temperature $T_g$. When toner 44 releases from finishing belt 220, which occurs somewhere between central rotatable member 203 and tensioning roller 225, it is preferably at a temperature below $T_g$. Receivers that pass through first nip 211 therefore receive a smooth, glossy finish, and receivers that pass through second nip 212 receive a matte finish. Finishing belt 220 is preferably cooler during operation at tensioning roller 225 than central rotatable member 203. This provides gradual cooling of toner 44 as receiver 42 travels along finishing belt 220 from central rotatable member 203 to its release point (e.g. release point 222). Tensioning roller 225 or finishing belt 220 can be actively or passively cooled to achieve this. Fans, blowers, thermoelectric coolers, or other devices can be employed, or natural convection can carry heat away.

Rotating members 201, 202, and 203 can be formed of metals such as steel, stainless steel, or aluminum. Rotating members that are not heated (e.g. first rotating member 201 in FIGS. 2 and 3, central rotating member 203 in FIG. 4) can be formed of nonmetallic materials with low thermal conductivity, such has hard plastics.

Elastomer 204 can be of various formulations. Moreover, elastomer 204 can include a base cushion around or adjacent to the corresponding rotating member, and a topcoat around the base cushion. On the pressure roller of one of the nips, lower-thermal-conductivity elastomers such as EMERSON CUMING S5100 can be employed. Topcoats are useful to lower the surface energy; the topcoat can include fluoroplastics including PFA (perfluoroalkoxy), PTFE (polytetrafiuoroethylene), and PFE (polyfluoroethylene). On the impression member of one of the nips, a thermally conductive base cushion material is preferably used. An example is EMERSON CUMING EC4952. Thermally-conductive base cushions are particularly useful with internally-heated impression members, such as shown in FIG. 2. Topcoats, e.g. low surface energy fluoroplastic, can be applied on top of such a base cushion. Reference is made to U.S. Pat. No. 6,517,346, issued Feb. 11, 2003, entitled "FUSING STATION WITH IMPROVED FUSER ROLLER," by Chen et al. and U.S. Pat. No. 7,682,542, issued Mar. 23, 2010, entitled "METHOD OF MAKING FUSER MEMBER," by Chen et al., the disclosures of which are incorporated by reference herein.

Elastomer 204 has lower thermal conductivity than rotating members 201, 202, and 203, and therefore heats and cools more slowly. In various embodiments of the present invention, one of the rotating members 201, 202, 203 serves as an impression member at some times and as a pressure member at other times; this is referred to herein as the "multifunctional member." In FIG. 2, central rotating member 203 is the impression member of first nip 211 and the pressure member of second nip 212. This is discussed in more detail below with reference to FIG. 5. The multifunctional member preferably has a high thermal conductivity so that it will cool quickly after it has been used as an impression member, before it is used as a pressure member. FIG. 2 shows the multifunctional member as central rotating member 203, which does not have associated with it any elastomer 204.

In an embodiment, heat energy is transferred back and forth between the impression member of the fusing nip (here, second rotating member 202) and the impression member of the glossing nip (here, central rotating member 203). Receiver 42 passes through only one nip at a time. The impression member of the selected nip has a higher temperature than the pressure member of the selected nip. This is particularly important for duplex operations, in which already-fused toner should not be damaged or re-fused. Moreover, elevated pressure-member temperatures promote paper blistering in coated media. In this embodiment, after receiver 42 exits second nip 212, second rotating member 202 is hotter than central rotating member 203. When the next receiver 42 is to be fused in first nip 211, central rotating member 203 and second rotating member 202 are retained in mechanical contact with each other so that heat is transferred from second rotating member 202 to central rotating member 203. Second rotating member 202 and central rotating member 203 can be rotated to transfer heat over an increased percentage of the members' surfaces.

In an embodiment, finishing belt 220 is field-replaceable. Replacing finishing belt 220 has an effect similar to that of replacing the outer sleeve of the rotating member around which finishing belt 220 is entrained, which capability is not present in prior-art systems. Replacement of finishing belt 220 does not require replacement of any cores or bearings. In embodiments using lightweight belts (e.g. polyimide), shipment and storage requirements are much less than those requirements for replacement of rotating members.

Thin, hard materials in finishing belt 220 are typically more durable than elastomers or elastomer-coated materials. For example, perfluoroalkoxy (PFA) copolymer resins, such as DUPONT TEFLON PFA, can be used for a rotating-member sleeve. However, PFA-sleeved rollers applied to elastomer-coated cores can be damaged by paper edges, both in-track and cross-track. The softer of the two contacting surfaces gets the most damage. This damage can cause wear artifacts visible in high-quality prints. The relatively hard surface of finishing belt 220 reduces the probability of this type of damage and permits effective cold release (i.e. release of toner at a temperature below $T_g$ from finishing belt 220). This advantageously reduces artifacts in the high-gloss output of printer 100 (FIG. 1), which is typically used for high-quality outputs such as photographs. This type of damage is not as objectionable for less quality-sensitive images, which are typically low-gloss.

"Surface finish" refers to the general appearance of a printed image or document, independent of the content of that image. It includes texture, gloss, and other factors known in the art. Gloss refers to the reflectivity of the surface of the image under specular illumination. Gloss can be measured at various angles, and is reported in Gnn units, where nn is the angle off the normal from which test light is shone and at which the measurement is taken (incident angle=reflected angle). Gnn values are nonnegative numbers, where Gnn=100 is the reflectance of a gloss calibration standard (see ASTM standard D2457 for more details).

Figure 10:
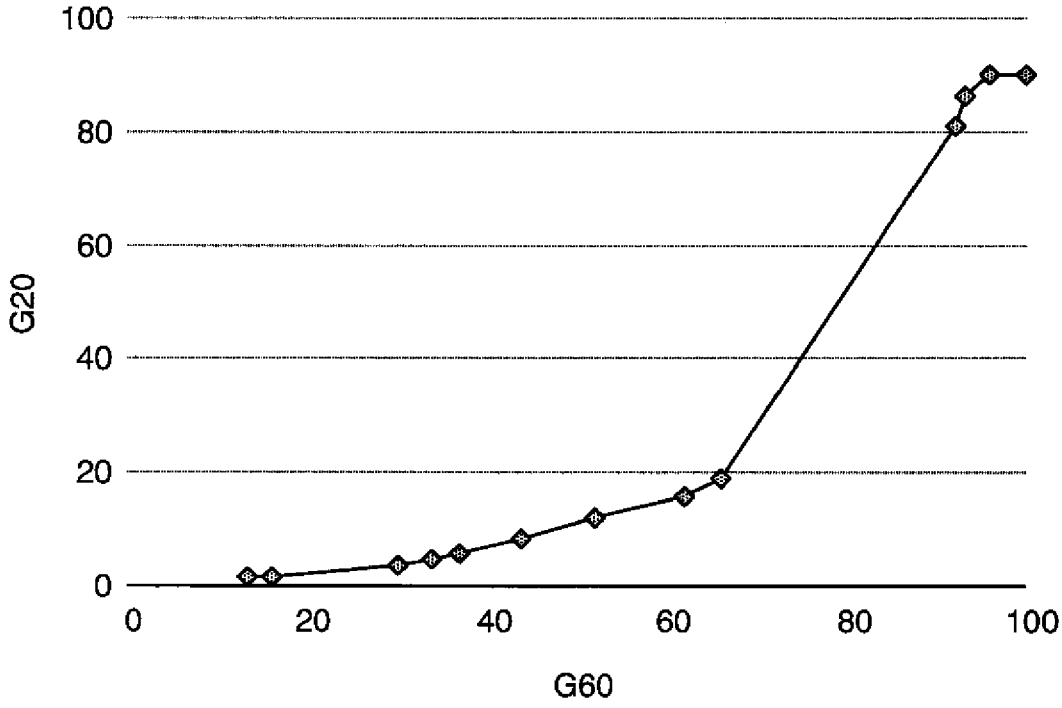
FIG. 10 shows an example of a relationship between G20 values and G60 values.

FIG. 10 shows an example of a relationship between G20 values and G60 values. G20 values are less than G60 values and are therefore typically used for higher-gloss surfaces. G85 is typically used for lower-gloss surfaces. In various embodiments of the present invention, G60 is used to measure surface finish of receivers 42 fused in a fusing nip (second nip 212 of FIG. 2), and G20 is used to measure surface finish of receivers 42 fused in a glossing nip (first nip 212 of FIG. 2).

A fusing nip typically imparts surface finishes having G60 in the range 4-70. The gloss imparted varies with temperature of the impression member of the fusing nip and dwell time of receiver 42 in the fusing nip (and thus on speed of receiver 42's passage through the fusing nip). A glossing nip typically imparts surface finishes having G20 in the range 80-100. The gloss imparted varies with energy applied to receiver 42 while it is in contact with finishing belt 220.

Figure 11:
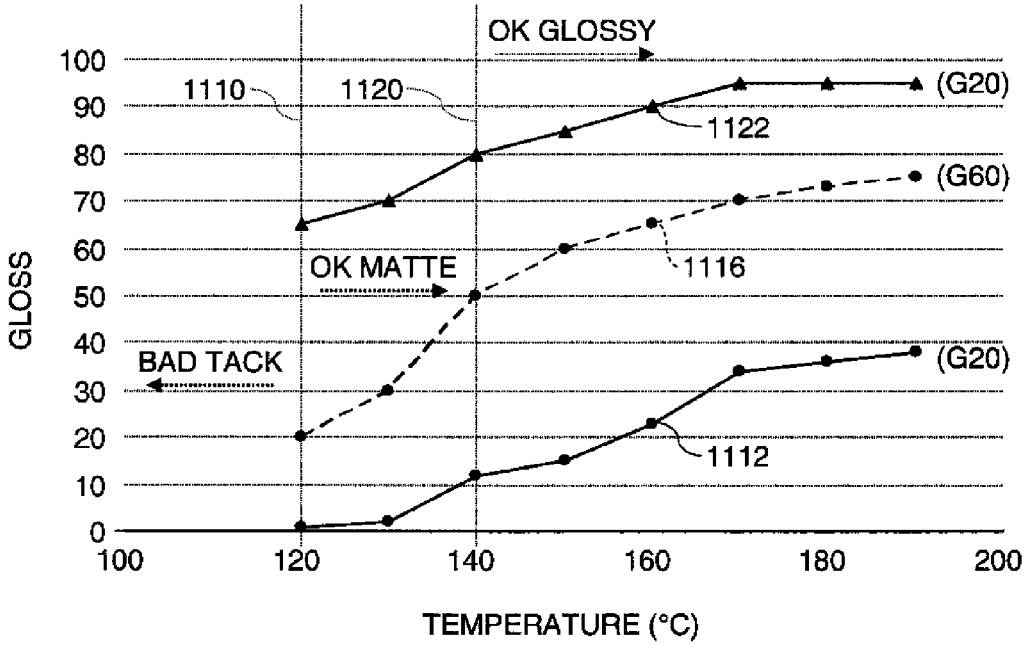
FIG. 11 shows a representative example of gloss varying with the temperature of the impression member.

FIG. 11 shows a representative example of gloss varying with the temperature of the impression member. This plot is representative of behavior a system according to an embodiment of the present invention can exhibit. The abscissa is the temperature of the impression member of either the fusing nip (curves 1112, 1116) or the glossing nip (curve 1122). The ordinate is gloss value, either G20 or G60.

Below temperature 1110, toner 43 (FIG. 2) does not adhere sufficiently to receiver 42 (FIG. 2) ("bad tack"). Above temperature 1110, the fusing nip can successfully produce a matte surface finish on receiver 42 ("OK matte"). Curve 1112 shows the G20 gloss measurement of receiver 42 out of the fusing nip (roller fusing) at various temperatures of the impression member of the fusing nip. As shown, gloss rises with temperature. Curve 1116 shows the G60 values corresponding to the G20 values on curve 1112. In this example, the preferable G60 range is achieved by temperatures from 120-170° C.

Above temperature 1110, the glossing nip (belt fusing) produces a glossy surface finish on receiver 42. Curve 1122 shows the G20 values for this condition. However, the preferable G20 range described above is not reached until temperature 1120 ("OK glossy"). In this example, the preferable range is therefore achieved by temperatures from 140-190° C.

Figure 3:
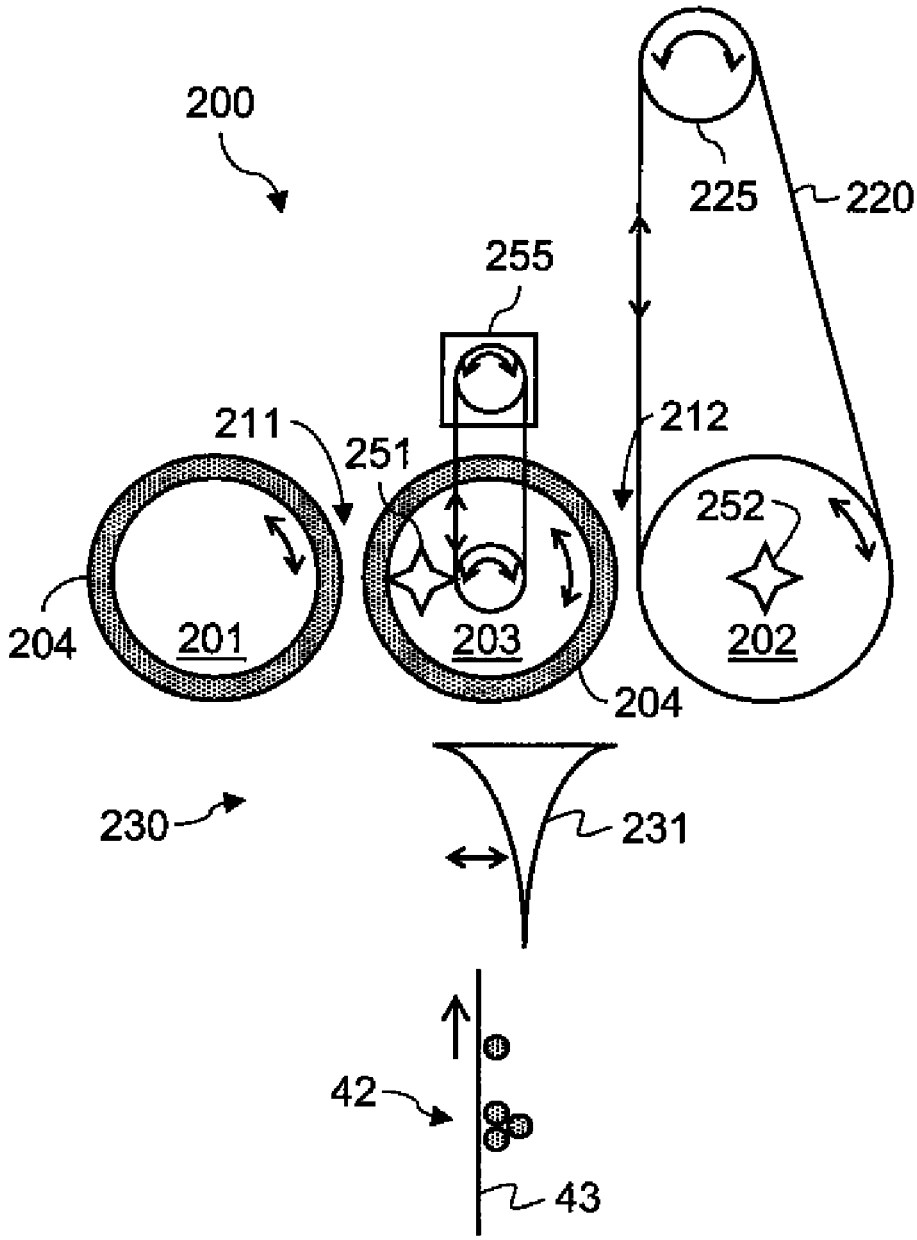

FIG. 3 is an elevation of apparatus 200 according to another embodiment. First rotatable member 201, second rotatable member 202, central rotatable member 203, diverter 230 with first position 231, receiver 42, image side 43, tensioning roller 225, drive 255, first heater 251, second heater 252 are as shown in FIG. 2. First rotatable member 201 and central rotatable member 203 are wrapped, covered, or coated with elastomer 204. Finishing belt 220 passes through second nip 212 but not first nip 211.

First nip 211 is a fusing nip having the central rotatable member 203 as its impression member. Second nip 212 is a glossing nip having second rotatable member 202 as its impression member. First heater 251 is effective to heat central rotatable member 203, and second heater 252 is effective to heat second rotatable member 202, as described above.

Figure 4:
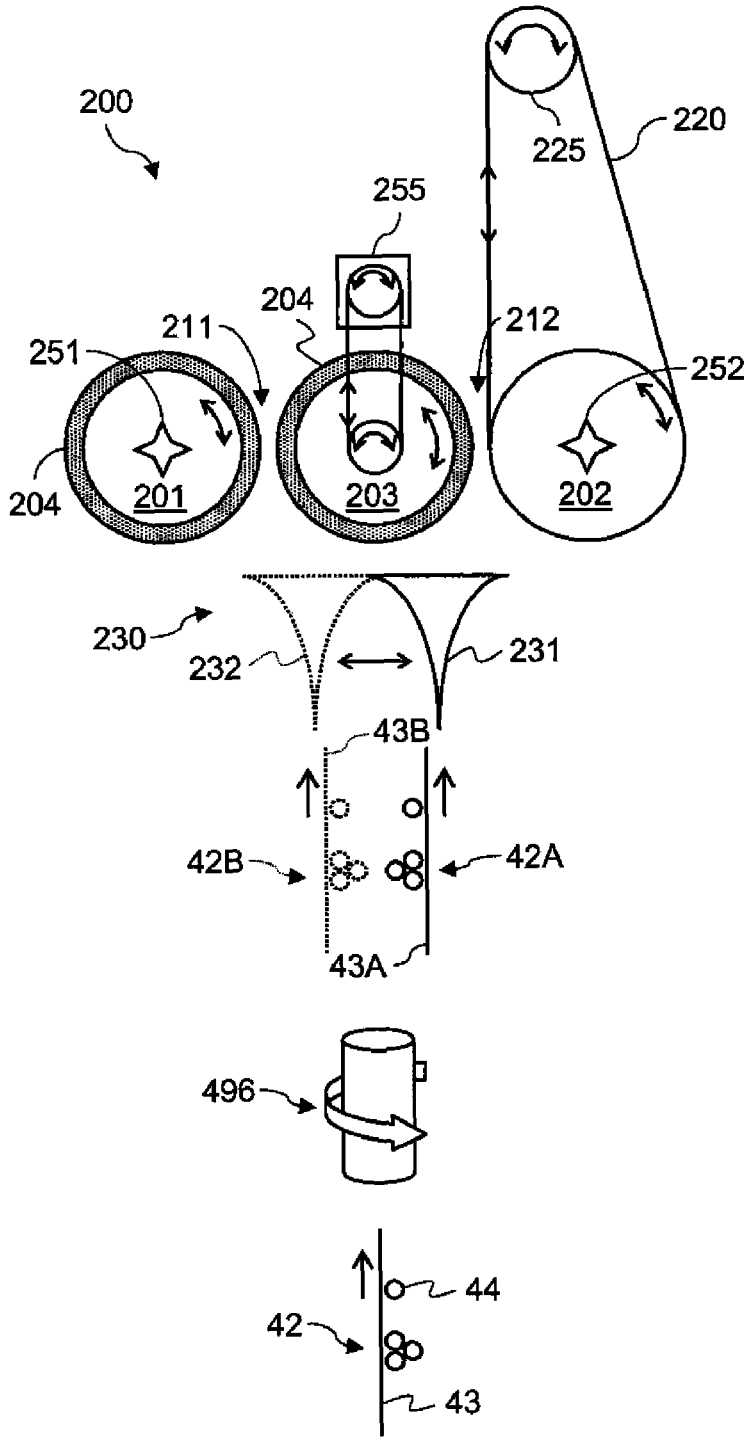

FIG. 4 is an elevation of apparatus 200 according to another embodiment. First rotatable member 201, second rotatable member 202, central rotatable member 203, diverter 230 with first position 231 and second position 232, receiver 42, image side 43, toner 44, tensioning roller 225, drive 255 and second heater 252 are as shown in FIG. 2. First rotatable member 201 and central rotatable member 203 are wrapped, covered, or coated with elastomer 204. Finishing belt 220 passes through second nip 212 but not first nip 211.

First nip 211 is a fusing nip having first rotatable member 201 as its impression member. Second nip 212 is a glossing nip having second rotatable member 202 as its impression member.

First heater 251 is effective when diverter 230 is in the first position to heat the impression member (first rotatable member 201) of first nip 211 to impart the first surface finish (a fused, e.g. matte, finish). Second heater 252 is effective when diverter 230 is in second position 232 for heating the impression member (second rotatable member 202) of the second nip 212 to impart the second surface finish (e.g. a glossy finish). First heater 251 and second heater 252 can be active at various times, as can be determined by one skilled in the art.

In an embodiment, apparatus 200 includes inverter 496 (represented graphically as a rotating cylinder) adapted to selectively flip receiver 42 as it moves along feed path 242 (FIG. 2) so that image side 43 faces the impression member of the selected nip, i.e. the nip corresponding to the selected position of the diverter. Apparatus 200 can also include a perfector for registering images on the front and back sides of receiver 42, as known in the art. Inverter 496 can be a grab-and-flip wheel, a rubber-band inline flipper, or other types of inverter known in the art.

In this example, receiver 42 enters inverter 496 with image side 43 facing to the right. When diverter 230 is in first position 231, inverter 496 flips receiver 42 before receiver 42 enters first nip 211. Receiver 42A is shown after flipping, with its image side 43A facing to the left. Image side 43A therefore faces first rotatable member 201, which member is the impression member of first nip 211.

When diverter 230 is in second position 232, inverter 496 does not flip receiver 42 before receiver 42 enters second nip 212. Receiver 42B is shown after passing through diverter 496, with its image side 43B still facing to the right. Image side 43B therefore faces second rotatable member 202, which member is the impression member of second nip 212.

Figure 5:
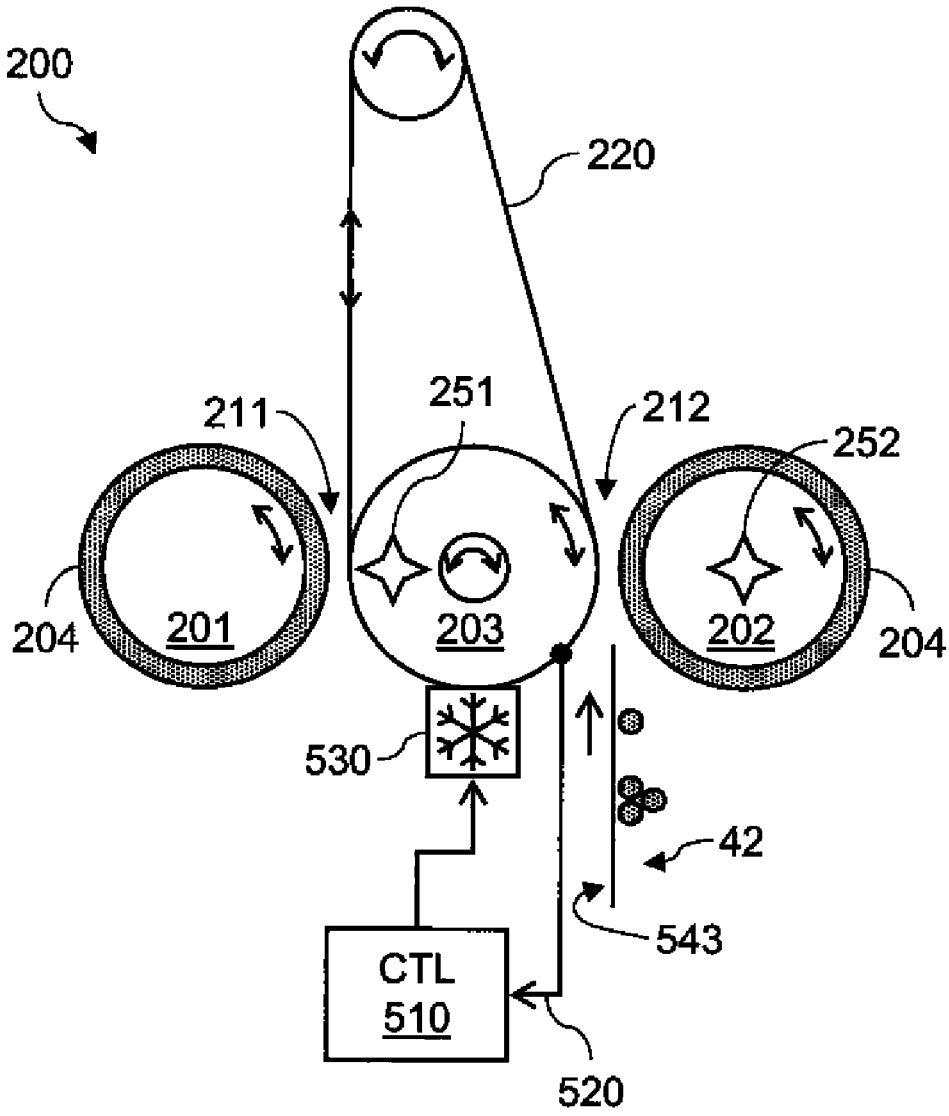
FIGS. 5-6 are elevations showing cooling features according to various embodiments of the present invention.

FIG. 5 shows cooling features according to an embodiment. First rotatable member 201, second rotatable member 202, central rotatable member 203, elastomer 204, first nip 211, second nip 212, first heater 251, second heater 252, and receiver 42 are as shown in FIG. 2.

Apparatus 200 includes controller 510, temperature probe 520 for measuring a surface temperature of the pressure member of a selected one of the nips, and cooling unit 530 (represented graphically as a box with a snowflake). In response to a measured surface temperature above a selected limit, controller 510 causes cooling unit 530 to cool the pressure member of the selected nip before the receiver is guided into the selected nip. In this example, the selected nip is second nip 212, and receiver 42 is shown about to enter second nip 212.

When a receiver is fused in first nip 211, central rotatable member 203 is heated by first heater 251. When the subsequent receiver 42 is to be fused in second nip 211, central rotatable member 203 changes function from the impression member (of first nip 211) to the pressure member (of second nip 212). For fusing or glossing in either nip, the pressure member is preferably cooler than the impression member, e.g. at room temperature. This reduces the likelihood of overheating and damaging receiver 42. In duplex systems, it also advantageously reduces re-melting and smearing of the image on the back side 543 of receiver 42.

To achieve these advantages, controller 510 causes cooling unit 530 to activate in order to remove excess heat from central rotatable member 203 before passing receiver 42 through second nip 212.

Figure 6:
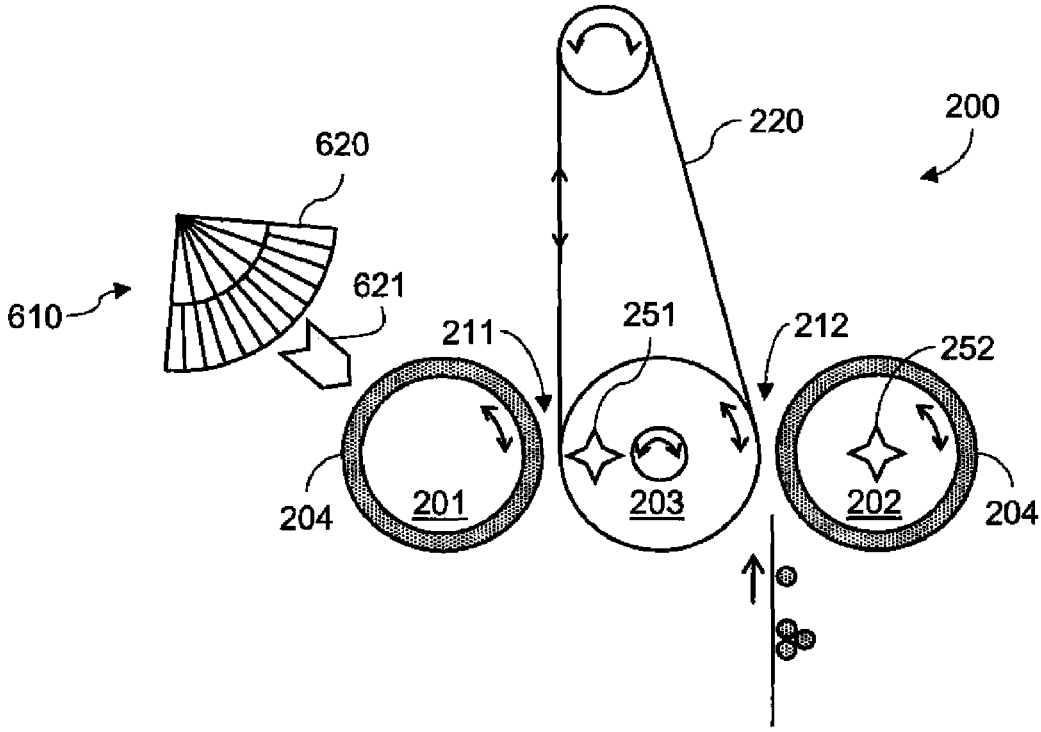

FIG. 6 shows cooling features according to another embodiment. First rotatable member 201, second rotatable member 202, central rotatable member 203, elastomer 204, first nip 211, second nip 212, first heater 251, second heater 252, and receiver 42 are as shown in FIG. 2.

One of the rotatable members is not an impression member of either nip. In FIG. 6, first rotatable member 201 is the pressure member of first nip 211, and is not involved in second nip 212, so it is the selected member, the member that is not an impression member of either nip (211, 212). Cooling system 610 maintains the temperature of the selected member below a selected limit. This provides the advantages discussed above to the nip of which the selected member is part.

FIG. 6 shows an embodiment of cooling system 610 using fan 620 (represented graphically as a hand fan) to direct airflow 621 at the surface of first rotatable member 201. Other embodiments of cooling systems can also be used. Fan 620 can be powered by electrical or heat energy. Cooling system 610 can include a temperature sensor and thermostat. Cooling system 610 can include a blower, thermoelectric cooler or radiator, the hot end of a Stirling motor, or another active or passive cooling system.

Figure 7:
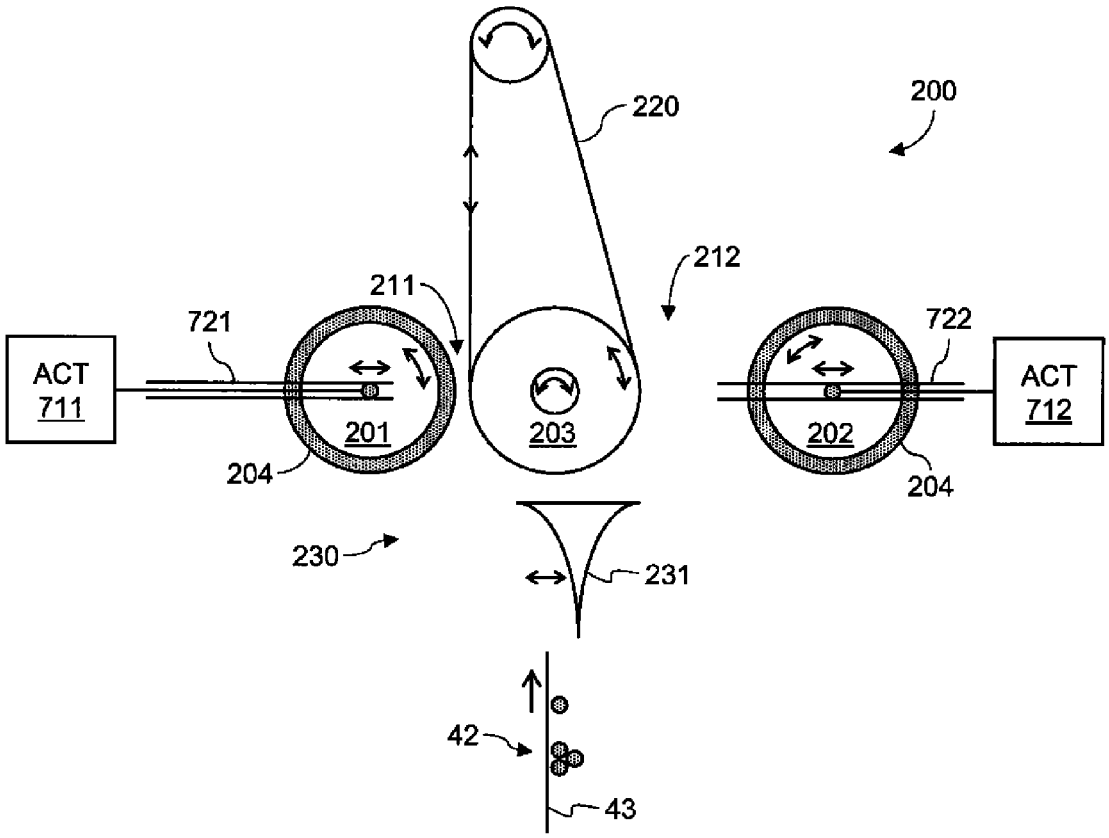
FIG. 7 is an elevation showing disengageable nips according to an embodiment of the present invention.

FIG. 7 shows disengageable nips according to an embodiment. First rotatable member 201, second rotatable member 202, central rotatable member 203, elastomer 204, first nip 211, second nip 212, diverter 230 with first position 231, receiver 42 and image side 43 are as shown in FIG. 2.

Apparatus 200 disengages the nip other than the engaged nip while the receiver is drawn through the engaged nip. In this example, diverter 230 is in first position 231 so receiver 42 will be engaged in and drawn through first nip 211. First rotatable member 201 and second rotatable member 202 ride on rails 721, 722 respectively, driven by respective actuators 711, 712. Second rotatable member 202 is drawn out of engagement with central rotatable member 203, thus disengaging second nip 212 while receiver 42 is drawn through first nip 211. This advantageously reduces wear on, and undesired heat transfer to, second rotatable member 202 while it is idle. It also reduces the rolling friction on central rotatable member 203, and thus reduces the energy consumed in driving central rotatable member 203. Actuators 711, 712 can be linear actuators, or servomotors or stepper motors driving chains or belts. Other embodiments of motors and actuators known in the art can also be used.

In another embodiment, first rotatable member 201 and second rotatable member 202 are mounted on pendulums or other shafts rotated by motors to disengage nips.

In another embodiment, first rotatable member 201 and second rotatable member 202 move vertically or longitudinally (the two directions perpendicular to the lateral axis of rails 721, 722) to disengage the nips.

In another embodiment, first rotatable member 201 and second rotatable member 202 are fixed in position, and central rotatable member 203 is moved by an actuator back and forth between them to engage one nip at a time.

Figure 8:
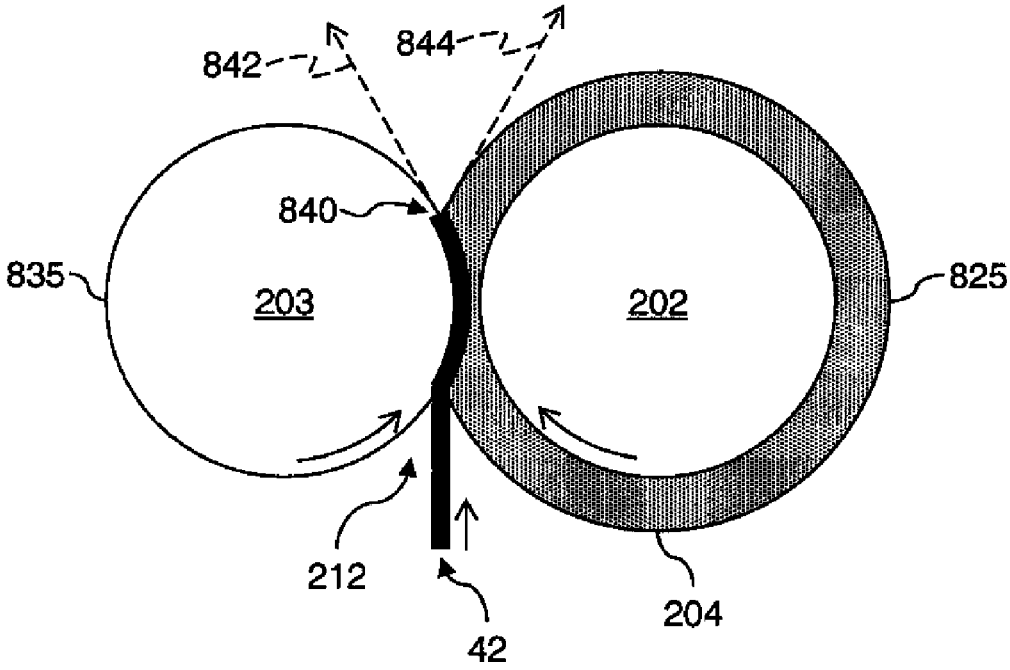
FIG. 8 is an elevation of rollers with different surface hardnesses.

FIG. 8 is an elevation of rollers with different surface hardnesses. Central rotatable member 203, second rotatable member 202, elastomer 204, and second nip 212 are as shown in FIG. 2. Central rotatable member 203 has surface 835; second rotatable member 202 has surface 825. Central rotatable member 203 is the pressure member of second nip 212, and second rotatable member 202 is the impression member of second nip 212. For clarity, finishing belt 220 and other parts are not shown.

The pressure member of at least one nip has higher surface hardness than the impression member. For example, surface 835 of the pressure member (central rotatable member 203) of second nip 212 is harder than surface 825 of the impression member (second rotatable member 202) of second nip 212. The fusing nip preferably has this property, but both nips can have this property.

"Hardness" or "durometer" refers to the deformation of a surface under known test conditions (e.g. applied force and shape of a test pin pressed into the surface). A first surface is harder than a second surface if the same test conditions produce greater surface deformation on the second surface than the first. Shore A is a commonly-used hardness scale. Elastomers generally have Shore A hardnesses from 20-70; steel measures over 90. Hard rollers can have thin elastomer coatings. The rotatable members can be covered with an elastomeric base cushion with a harder material, e.g. a metal, coated on top; the hardness of the surface then also depends on the thickness and hardness of the base cushion.

This difference in surface hardness improves the release geometry of a fusing nip, e.g. second nip 212, compared to a nip having rollers of equal surface hardnesses. Toner in contact with a heated impression member is in a molten or semi-molten state, and therefore adheres to the surface of the impression member through surface tension. For rollers of equal surface hardnesses, there is little force to counteract this adhesion and separate receiver 42 cleanly from the surface of the impression member. However, separation is necessary for normal operation of printer 100 (FIG. 1), since otherwise the next receiver 42 (e.g. the next sheet) will not be able to contact the impression member and receiver jams will happen in printer 100 (the first receiver will be in the way of the next receiver).

Rollers of different surface hardnesses, by contrast, give rise to forces due to their geometries that cleanly release receiver 42 from the impression member. When a harder and a softer roller are pressed together, the harder makes an indentation in the surface of the softer. For example, central rotating member 203 (the pressure member) makes an indentation in the elastomer over second rotating member 202 (the impression member). Receiver 42 therefore takes the path shown, conforming to the surface of central rotating member 203 through the indentation. At release point 840, receiver 42 is pointing in direction 842. The stiffness of receiver 42 (however much or little it has) develops a force which opposes attempts to change the direction of receiver 42 away from direction 842. The adhesion of receiver 42 to second rotating member 202 develops a force which attempts to pull receiver 42 in direction 844. One skilled in the art can select direction 842 for a given stiffness of receiver 42 so that the force in direction 842 will overcome the adhesion force in direction 844, and receiver 42 will release (separate or de-tack) from the surface of second rotating member 202.

Figure 9:
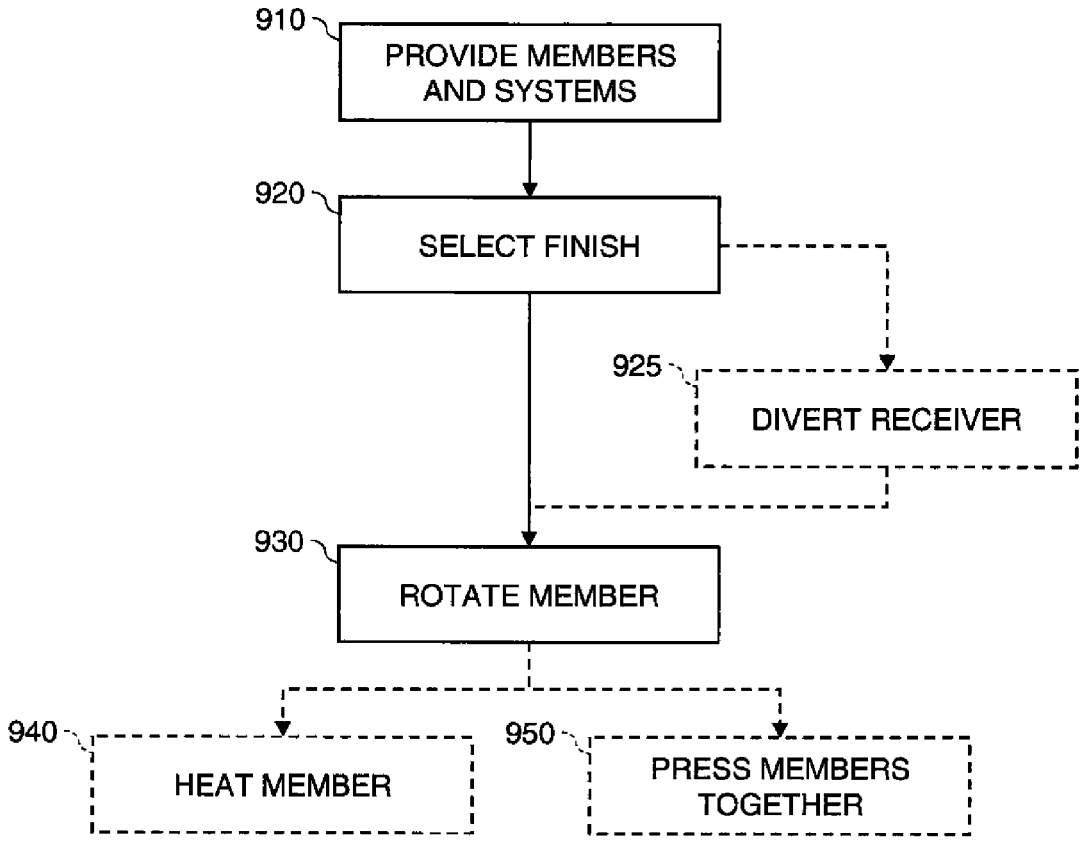
FIG. 9 is a flowchart of an embodiment of a method useful with the present invention.

FIG. 9 is a flowchart of an embodiment of a method useful with the present invention. Referring to FIG. 9 and also to FIGS. 1-2, there is shown a method of forming a variable finish on receiver 42 by fusing toner 44 to receiver 42 in an electrophotographic printer 100. By "variable" it is meant that the surface finish of a particular receiver 42 can be selected from a plurality of alternatives.

In step 910, a rotatable member is provided (e.g. central rotatable member 203). A fusing system is provided (e.g. second rotatable member 202 and second heater 252) disposed with respect to the rotatable member to form a fusing nip (e.g. second nip 212). A glossing system is provided (e.g. first rotatable member 201, first heater 251, finishing belt 220, and tensioning roller 225) having a glossing belt (e.g. finishing belt 220). The glossing system is disposed with respect to the rotatable member to form a glossing nip (e.g. first nip 211). The fusing system and glossing system are adapted to fuse toner 44 to receiver 42 to produce respective ranges of finish of the fused toner 44. Ranges of finish are discussed further above with reference to FIGS. 10 and 11.

The ranges of finish of the fusing system and glossing system preferably do not overlap, as discussed above. For example, the fusing system can have a range of finish of G60=4-70, which can correspond to G20=0-20 (see FIG. 10). The glossing system can have a range of finish of G20=80-100. These two G20 ranges do not overlap.

In step 920, a surface finish is selected within one of the respective ranges (i.e. the ranges of the fusing system and the glossing system). One of the nips is selected so that the finish range of the system corresponding to the selected nip includes the selected finish.

In optional step 925, a diverter 230 is provided disposed in receiver feed path 242 to selectively engage the moving receiver 42 in a first position 231 or a second position 232, so that as receiver 42 moves along feed path 242 through diverter 230 in first position 231, it engages the glossing nip (or the fusing nip), and as the receiver moves along the feed path through the diverter in the second position, it engages the fusing nip (or the glossing nip). The orientation of the diverter can be selected by those skilled in the art. Receiver 42 is diverted to engage with the selected nip.

In step 930, the rotatable member is rotated to feed receiver 42 through the selected nip to fuse toner 44 to receiver 42 and form the selected finish on the receiver.

In an embodiment, the rotatable member feeds the receiver through the selected nip at a first speed when the fusing system is selected, and at a second speed different from the first speed when the glossing system is selected.

In various embodiments, first rotatable member (e.g. second rotatable member 202) is provided in the fusing system and a second rotatable member (e.g. first rotatable member 201) is provided in the glossing system, so that one of the rotatable members forming each nip (i.e. one of the rollers in the fusing or glossing system, or the rotatable member with respect to which the fusing and glossing systems are disposed) is an impression member adapted to provide the selected finish to the image side of the receiver. This is discussed above with reference to FIG. 2.

In optional step 940, the impression member of the selected nip is heated to a temperature corresponding to the selected finish while the receiver is fed through the selected nip.

In optional step 950, the pressure member of the selected nip contacts the impression member of the selected nip with a pressure corresponding to the selected finish while the receiver passes through the selected nip.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

Parts List

31, 32, 33, 34, 35 printing module
40 supply unit
42, 42A, 42B receiver
43, 43A, 43B image side
44 toner
50 transfer subsystem
60 fuser
62 fusing roller
64 pressure roller
66 fusing nip
68 release fluid application substation
69 output tray
99 logic and control unit (LCU)
100 printer
101 transport web
106 cleaning station
200 apparatus
201, 202 rotatable member
203 central rotatable member
204 elastomer
211, 212 nip
220 finishing belt
222 release point
225 tensioning roller
230 diverter
231, 232 position
242 feed path
250 structure
251, 252 heater
255 drive
496 inverter
510 controller
520 temperature probe
530 cooling unit
543 back side
610 cooling system
620 fan
621 airflow
711, 712 actuator
721, 722 rail
825, 835 surface
840 release point
842, 844 direction
910 step provide members and systems
920 step select finish
925 step divert receiver
930 step rotate member
940 step heat member
950 step press members together
1110 temperature
1112, 1116 curve
1120 temperature
1122 curve

The invention claimed is:

1. Apparatus for selectively providing a surface finish to a receiver having an image side, comprising:

a. a first, a second, and a central rotatable member, the first and the central rotatable members arranged to form a first nip and the second and the central rotatable members arranged to form a second nip, wherein one of the rotatable members forming each nip is an impression member adapted to provide a respective desired surface finish to the image side of the receiver, and the other rotatable member forming each nip is a pressure member adapted to maintain the receiver in contact with the impression member while the receiver travels through the respective nip;

b. a finishing belt entrained around one of the rotatable members and movable with that rotatable member, so that the finishing belt passes through one of the nips;

c. a diverter disposed in a receiver feed path to selectively engage the moving receiver in a first or a second position, so that as the receiver moves along the feed path through the diverter in the first position, it engages the first nip, and as the receiver moves along the feed path through the diverter in the second position, it engages the second nip; and d. a structure for providing the selected surface finish, comprising:

i. a drive for selectively rotating the central rotatable member to draw the receiver through the engaged nip;

ii. a first heater effective when the diverter is in the first position to heat the impression member of the first nip to impart the first surface finish; and iii. a second heater effective when the diverter is in the second position for heating the impression member of the second nip to impart the second surface finish.

2. The apparatus according to claim 1, wherein the rotatable members are rollers.

3. The apparatus according to claim 1, wherein the receiver is a planar medium.

4. The apparatus according to claim 1, wherein the first nip is a glossing nip, the central rotatable member is the impression member of the first nip, the second nip is a fusing nip, the second rotatable member is the impression member of the second nip, and the finishing belt passes through the first and second nips.

5. The apparatus according to claim 1, wherein the first nip is a fusing nip, the central rotatable member is the impression member of the first nip, the second nip is a glossing nip, the second rotatable member is the impression member of the second nip, and the finishing belt passes through the second nip but not the first nip.

6. The apparatus according to claim 1, further including an inverter adapted to selectively flip the receiver as it moves along the feed path so that the image side faces the impression member of the engaged nip.

7. The apparatus according to claim 6, wherein the first nip is a fusing nip, the first rotatable member is the impression member of the first nip, the second nip is a glossing nip, the second rotatable member is the impression member of the second nip, and the finishing belt passes through the second nip but not the first nip.

8. The apparatus according to claim 1, further including a tensioning roller, wherein the finishing belt is further entrained around the tensioning roller and is cooler during operation at the tensioning roller than at the central rotatable member.

9. The apparatus according to claim 1, wherein the pressure member of each nip has higher surface hardness than the impression member of the nip.

10. The apparatus according to claim 1, further including a controller, a temperature probe for measuring a surface temperature of the pressure member of a selected one of the nips, and a cooling unit, wherein the controller, in response to a measured surface temperature above a selected limit, causes the cooling unit to cool the pressure member of the selected nip before the receiver is guided into the selected nip.

11. The apparatus according to claim 1, wherein a selected one of the rotatable members is not an impression member of either nip, further including a cooling system for maintaining the temperature of the selected rotatable member below a selected limit.

12. The apparatus according to claim 1, further including means for disengaging the nip other than the selected nip while the receiver is drawn through the selected nip.

* * * * *